US006918447B2

(12) United States Patent
Robinson, Jr.

(10) Patent No.: US 6,918,447 B2
(45) Date of Patent: Jul. 19, 2005

(54) FIRE PROTECTION APPARATUS AND METHOD

(76) Inventor: Edward L. Robinson, Jr., P.O. Box 224, Baxter Springs, KS (US) 66713

( * ) Notice: Subject to any disclaimer, the term of this patent is extended or adjusted under 35 U.S.C. 154(b) by 31 days.

(21) Appl. No.: 10/355,523

(22) Filed: Jan. 31, 2003

(65) Prior Publication Data

US 2004/0159448 A1 Aug. 19, 2004

(51) Int. Cl.[7] ..... A62C 2/00

(52) U.S. Cl. ..... 169/45; 169/5; 169/48; 169/54; 169/64; 52/2.22; 52/1; 160/44; 405/132

(58) Field of Search ..... 169/5, 37, 45, 169/46, 48, 49, 54, 64, 50; 52/2.22; 160/44; 405/132, 141, 144

(56) References Cited

U.S. PATENT DOCUMENTS 3,645,337 A * 2/1972 Livingston ..... 169/48
3,687,185 A 8/1972 Singer
3,872,927 A * 3/1975 Stults ..... 169/48
3,877,525 A 4/1975 Husson et al.
3,960,216 A 6/1976 Isobe
4,077,474 A 3/1978 Hattori
4,811,793 A 3/1989 Lokken
5,188,186 A * 2/1993 Nash ..... 169/48
5,210,985 A 5/1993 Hsu
5,469,920 A * 11/1995 Conti et al. ..... 169/48
5,511,621 A 4/1996 Yao
5,727,634 A 3/1998 Ishida et al.
5,809,699 A 9/1998 Joly

* cited by examiner

*Primary Examiner*—Steven J. Ganey
(74) *Attorney, Agent, or Firm*—Derek P. Martin; Martin & Associates, L.L.C.

(57) ABSTRACT

A fire protection apparatus includes a plurality of bladders that are substantially filled with a non-flammable liquid via a manifold that is coupled to a source of non-flammable liquid and includes one or more nozzles that discharge the non-flammable liquid into each of the plurality of bladders. In one specific embodiment, the apparatus is initially in a substantially collapsed state at or near a ceiling. When fire or smoke is detected, the non-flammable liquid flows into the manifold. As the plurality of bladders begin to fill with non-flammable liquid, the weight of the filling bladders causes the fire protection apparatus to deploy, spanning from ceiling to floor. The bladders may include one or more discharge orifices that allow the non-flammable liquid to flow out of the bladder and down the exterior of the bladder once the bladder is filled to the level of its discharge orifices. In another embodiment, stationary bladders may be placed in walls, such as between buildings or between rooms in a building, to provide fire protection. These stationary bladders are filled using a manifold similar to the deployable embodiment until the bladders are substantially full. In both embodiments, the bladders may include separations between one or more of the bladders that allow a person to pass through the fire protection apparatus, if needed.

27 Claims, 8 Drawing Sheets

FIRE PROTECTION APPARATUS AND METHOD

BACKGROUND OF THE INVENTION

1. Technical Field

This invention generally relates to the field of fire protection, and more specifically relates to apparatus and methods for inhibiting the spread of fire and smoke.

2. Background Art

Various fire protection devices are known in the art. For example, fire doors have been used to inhibit the spread of fire between different parts of a building. When a fire alarm sounds, fire doors are typically shut and are not to be opened until the threat of fire has been eliminated.

Some devices in the prior art provide a curtain that inhibits the spread of fire. For example, one example of a prior art fire curtain is shown in U.S. Pat. No. 5,809,699 "Fire Curtain", issued on Sep. 22, 1998 to Joly. The '699 patent discloses a two-walled curtain that deploys from a ceiling. Water is sprayed from the top of the curtain between the two walls onto the inside surface of the two walls. The water runs down inside surface of the walls and accumulates in the bottom to form a seal with the floor. A drain opening near the bottom of the curtain drains away the water so it does not spill on the floor, and keeps only a small amount of water in the bottom of the curtain.

One significant problem with the fire curtain disclosed in the '699 patent occurs when water flow stops. Oftentimes during a fire, a sprinkler system will function for a short period of time, but the fire itself or a collapsing structure can cause the sprinkler system to fail. With the fire curtain in the '699 patent, once the water system providing the water spray fails, there is no water to cool the inside walls of the fire curtain. Thus, once the water system fails, the fire curtain would quickly fail as well.

Another problem with the fire curtain in the '699 patent is that it is a single, hollow baffle that spans from ceiling to floor between two walls, and thus provides a barrier to persons who may need to pass. Of course, a fire is an event where people may need to evacuate. The '699 fire curtain may serve to retard the spread of a fire, but will also inhibit the evacuation of people. What is needed is an improved fire protection device that provides enhanced fire protection even when the water supply fails, and through which people may easily pass during a fire.

DISCLOSURE OF INVENTION

According to the preferred embodiments, a fire protection apparatus includes a plurality of bladders that are substantially filled with a non-flammable liquid via a manifold that is coupled to a source of non-flammable liquid. The manifold includes one or more nozzles that discharge the non-flammable liquid into each of the plurality of bladders. In one specific embodiment, the apparatus is initially in a substantially collapsed state at or near a ceiling. When fire or smoke is detected, the non-flammable liquid flows into the manifold. As the plurality of bladders begin to fill with non-flammable liquid, the weight of the filling bladders causes the fire protection apparatus to deploy, spanning from ceiling to floor. The bladders may include one or more discharge orifices that allow the non-flammable liquid to flow out of the bladder and down the exterior of the bladder once the bladder is filled to the level of its discharge orifices. In the alternative, the bladders may be constructed of a semi-permeable flexible material that allows the non-flammable liquid to seep from the inside to the outside and run down, thereby coating the outside of the bladders with the non-flammable liquid. In another embodiment, stationary bladders may be placed in walls, such as between buildings or between rooms in a building, to provide fire protection. These stationary bladders are filled using a manifold similar to the deployable embodiment until the bladders are substantially full. In both embodiments, the bladders may include separations between one or more of the bladders that allow a person to pass through the fire protection apparatus, if needed.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements, and.

BEST MODE FOR CARRYING OUT THE INVENTION

The preferred embodiments provide a fire protection apparatus that substantially fills with a non-flammable liquid (such as water) and thereby provides a barrier to the spread of fire and smoke. When the term "water" is used herein, it is used as one specific non-flammable liquid that may be used within the scope of the preferred embodiments, which expressly extend to any non-flammable liquid. In one specific embodiment, the apparatus includes a plurality of bladders that are initially in a substantially collapsed position, preferably in an overhead area. When a fire alarm sounds, water is directed through a manifold, which directs the water into each bladder. The weight of the water filling the bladders causes the apparatus to deploy downward until the bottom portions of the bladders contact some surface, creating a barrier that inhibits the spread of fire and smoke. In a second specific embodiment, an apparatus is placed in a stationary position, and water is then directed into the plurality of bladders until the plurality of bladders are substantially filled. This second embodiment is especially useful in creating a stationary fire barrier, such as between buildings or between rooms in a building. In both embodiments, the bladders may include separations that allow a person to walk through the bladders, even when filled with water.

Figure 1:
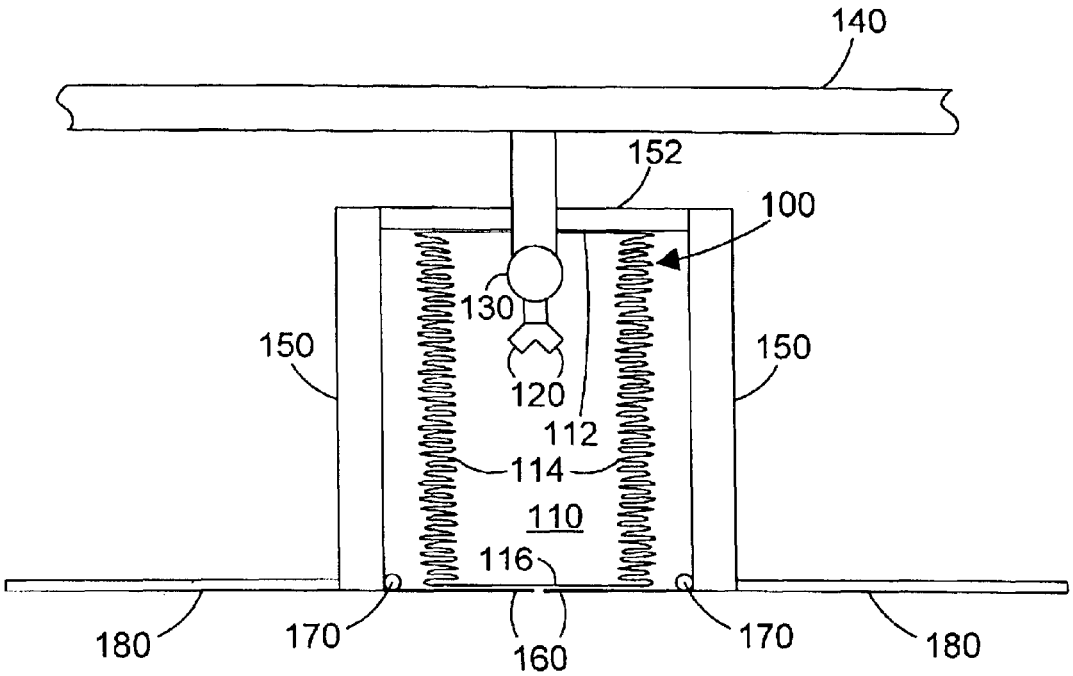
FIG. 1 is a side cross-sectional view of the fire protection apparatus in a collapsed state in accordance with a first embodiment of the present invention.
Figure 1:
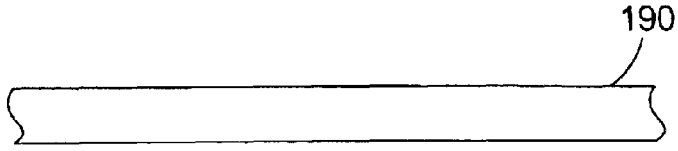

Referring now to FIG. 1, a fire protection apparatus 100 in accordance with the preferred embodiments is initially in a collapsed position within a ceiling, and comprises a plurality of collapsible bladders 110 that each have a top surface 112, two side surfaces 114, and a bottom surface 116. The top surface 112 is preferably anchored to an upper structural member 152. In the specific example in FIG. 1, the upper structural member 152 is coupled to two other structural members 150, such as ceiling joists. We assume for the example in the figures that the structural members 150 provide sufficient structural support to support the apparatus 100 when deployed with all of its bladders substantially filled with water. The apparatus 100 includes a manifold 130 that is coupled to a source of water, such as a water pipe 140. The manifold preferably includes two nozzles 120 in each bladder that spray the water onto the side walls 114. Note, however, that a single nozzle or more than two nozzles per bladder could also be used within the scope of the preferred embodiments.

Figure 2:
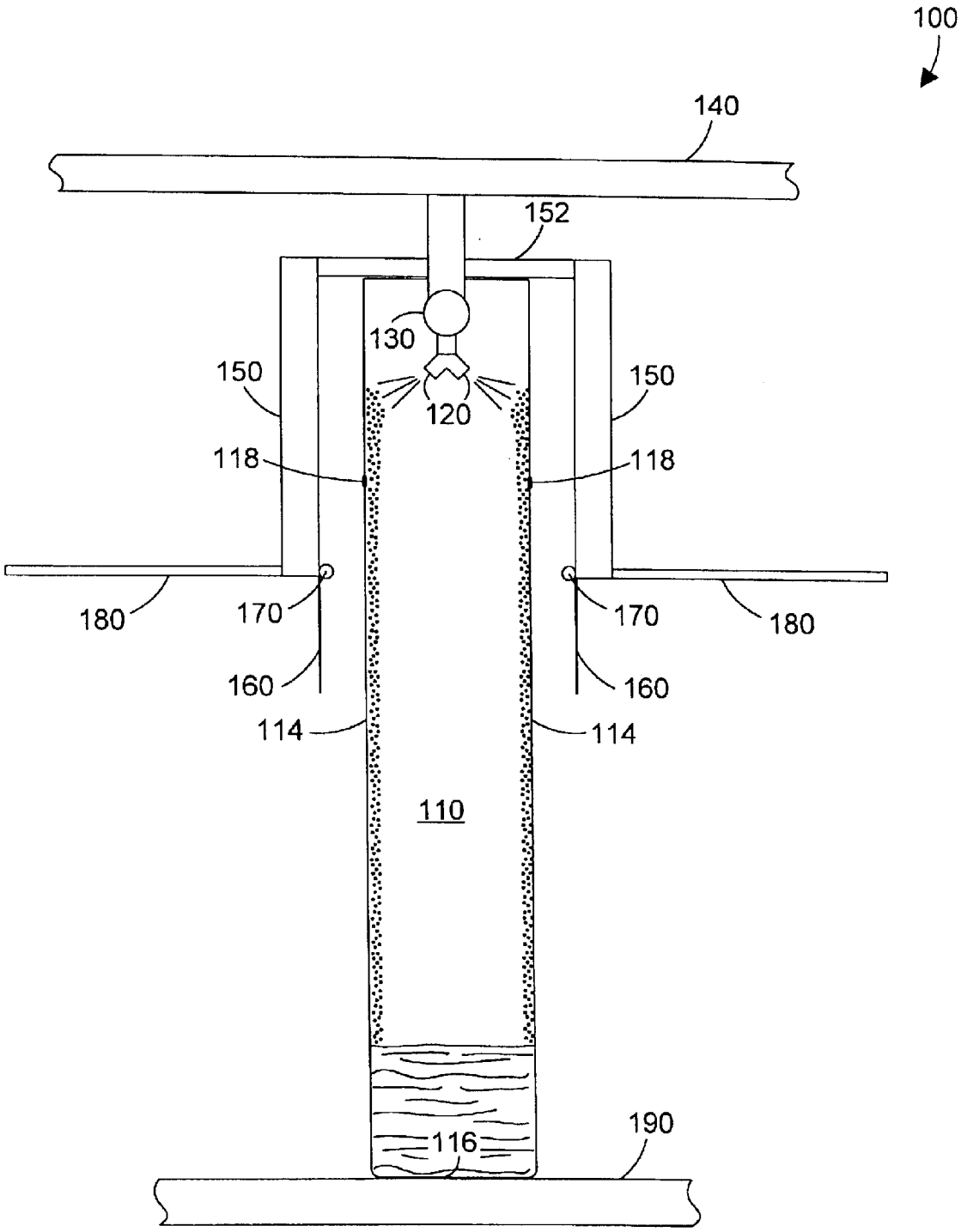
FIG. 2 is a side cross-sectional view of the fire protection apparatus of FIG. 1 when the apparatus has been deployed to the floor and is filling with water.
Figure 3:
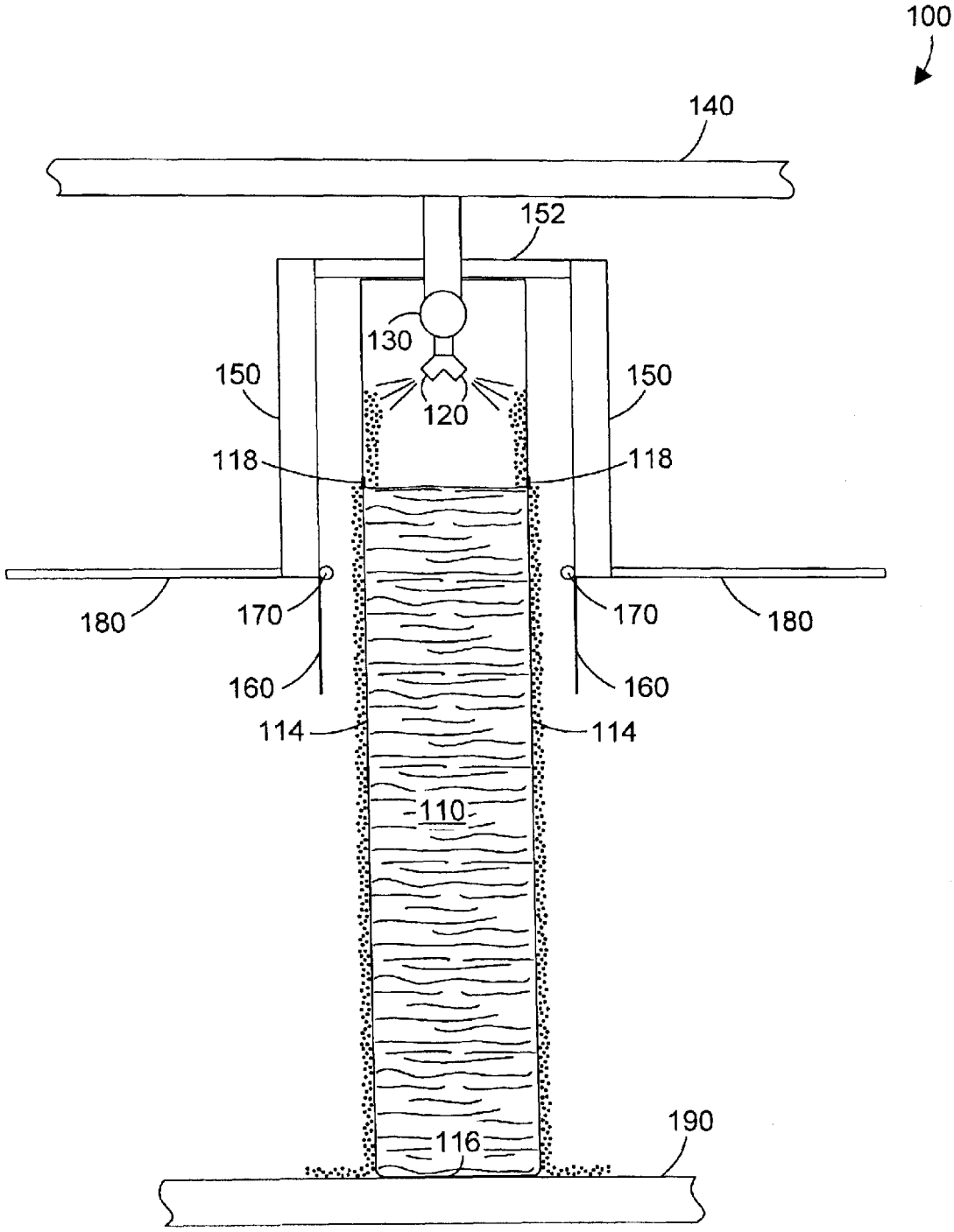
FIG. 3 is a side cross-sectional view of the fire protection apparatus of FIGS. 1 and 2 after the bladders have filled to the level of their discharge orifices, which causes the water to overflow and run down the exterior of each bladder, thereby coating the exterior of each bladder with water.

The configuration of FIGS. 1–3 includes doors 160 that are initially in a closed position as shown in FIG. 1 when the apparatus 100 has not yet begun filling with water. Doors 160 may be flush with the ceiling 180, as shown in FIG. 1, or may be recessed within the ceiling or extend downward from the ceiling within the scope of the preferred embodiments. The doors 160 are preferably held closed using spring hinges 170. The spring strength in spring hinges 170 is preferably enough to hold the weight of the collapsed bladders 110 when empty. Note that apparatus 100 is preferably located above a floor 190 or other suitable surface.

Apparatus 100 is shown in FIG. 2 in a deployed position, but before the bladders 110 have been substantially filled with water. We assume in FIG. 2 that a fire alarm has sounded, which means that apparatus 100 needs to be deployed to create a barrier that inhibits the spread of fire and smoke. We further assume that water pipe 140 is a source of water that is activated by a fire alarm. Most commercial building include sprinkler systems that inhibit the spread of fire. Water pipe 140 could be coupled to the same pipe system that supplies water to the sprinklers in a building. Of course, water pipe 140 could be an entirely separate system as well.

For the example of water pipe 140 being coupled to a sprinkler system, when the sprinkler system is activated, water flows through pipe 140 into manifold 130 and out the discharge nozzles 120. As shown in FIG. 2, the water flows downward and begins filling the bladders 110. At some point, the weight of the water in the bladders overcomes the bias of spring hinges 170 causing doors 160 to open and causing the collapsed sides 114 to extend downward, as shown in FIG. 2. Note that the length of apparatus 100 is preferably sufficient to reach the floor 190 or other suitable surface to create a barrier to the spread of fire and smoke.

In one specific embodiment within the scope of the preferred embodiments, bladders 110 preferably include one or more discharge orifices 118 on each side, as shown in FIGS. 2 and 3. The purpose of the discharge orifices 118 is two-fold. First, the location of the discharge orifices 118 define how full the bladders 110 may fill with water. Thus, as the bladders continue to fill, the water level in the bladders will eventually reach the level of the discharge orifices, as shown in FIG. 3. Second, once the bladders have been filled to the level of the discharge orifices 118, the discharge orifices 118 allow water to flow from the inside of the bladders to the exterior of the bladders, and to flow down the side walls 114 of the bladders onto the floor, as shown in FIG. 3. Note that the location of the discharge orifices 118 is preferably near the top of each bladder, so that water cascades down the outside of side walls 114 once the water in the bladder reaches the level of the discharge orifices 118.

The fire protection apparatus of the preferred embodiments offers two significant advantages over the "Fire Curtain" disclosed in U.S. Pat. No. 5,809,699. First, the bladders are substantially filled with water. This provides significantly more protection than a sheet of plastic with water running down the inside, as shown in the '699 patent. In addition, the protection provided by bladders filled with water does not stop if the water supply stops supplying water. Thus, even if the sprinkler system fails, the filled bladders remain in place effectively inhibiting the spread of fire and smoke, even though no water is running anymore.

A second significant advantage of the apparatus of the preferred embodiments is that it contains a plurality of bladders rather than a single, monolithic curtain. The bladders may be connected together to form a barrier, but the most preferred embodiments include a separation between one or more of the bladders that allow a person to pass through the apparatus, if needed. This is very useful for the evacuation of people in the building and for the passage of firefighters to fight the fire.

Figure 4:
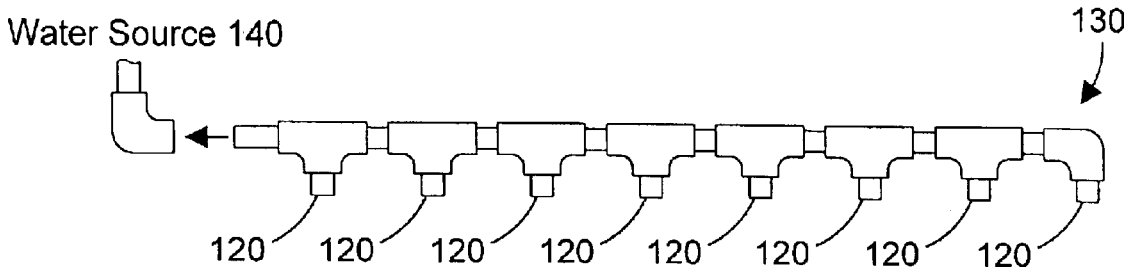
FIG. 4 is a plan view of one suitable manifold used for filling the multiple bladders in accordance with the preferred embodiments.

The apparatus 100 includes a manifold 130 that distributes the water to each of the bladders 110. One possible implementation of manifold 130 within the scope of the preferred embodiments is shown in FIG. 4. One end of manifold 130 is preferably connected to a water source 140. The manifold includes one or more discharge nozzles 120 for each bladder. In the most preferred embodiment, manifold 130 includes two discharge nozzles 120 per bladder, with one directed to each side wall 114 of bladder 110, as shown in FIGS. 1–3. In this manner, water from water source 140 may flow through manifold 130 out the discharge nozzles 120 into the bladders.

Figure 5:
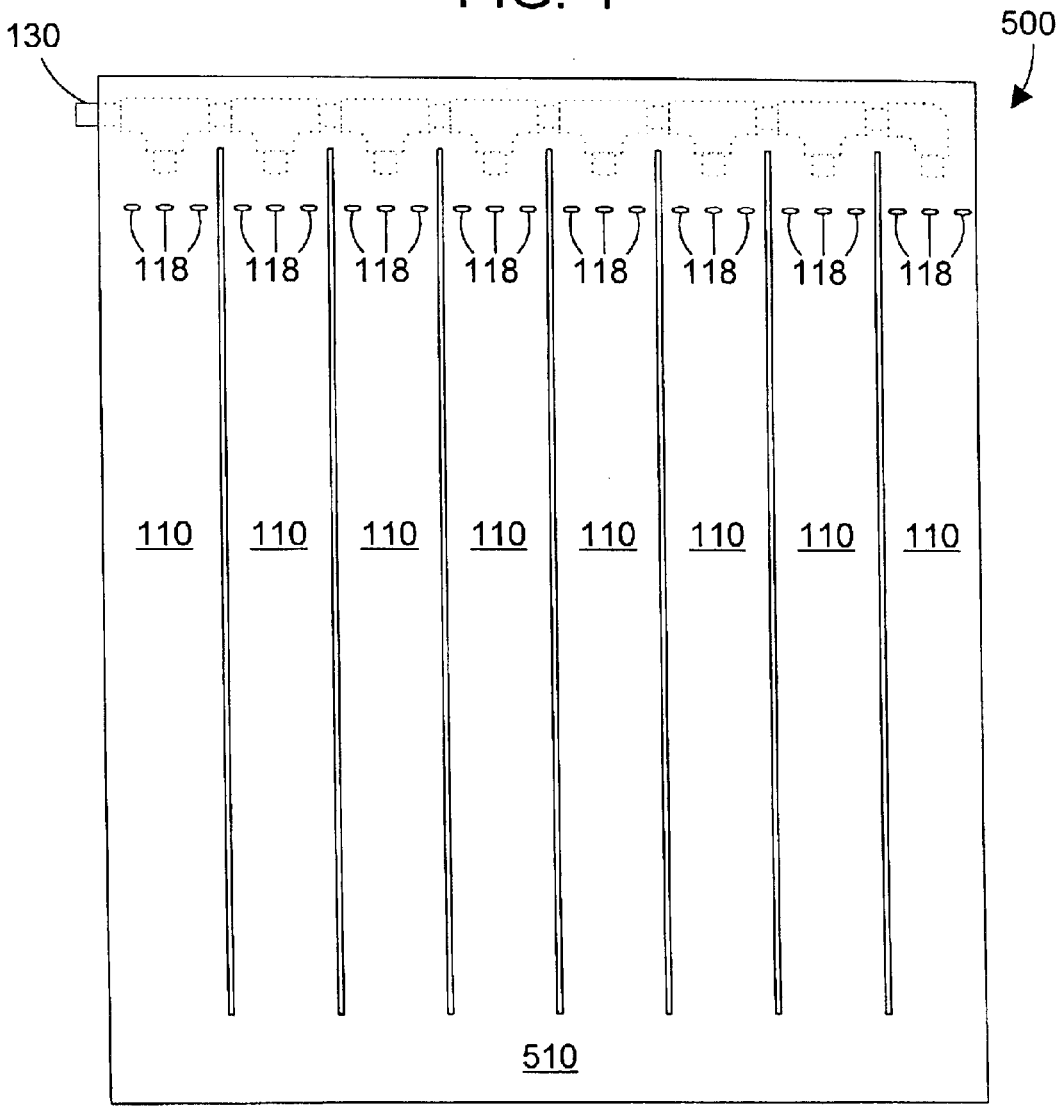
FIG. 5 is a front view of a first specific implementation of the fire protection apparatus of the preferred embodiments, where the bottom portions of each bladder are interconnected.

One possible configuration for the fire protection apparatus within the scope of the preferred embodiments is shown as apparatus 500 in FIG. 5. Apparatus 500 is preferably formed of two pieces of plastic that are laid on top of each other in the configuration shown in FIG. 5 and sealed at the outside perimeter and between bladders 110. The result is a configuration similar to blow-up mattresses that are often used as flotation devices in swimming pools. Manifold 130 is disposed between the two pieces of plastic, so it is shown in phantom in FIG. 5. Each bladder 110 may include one or more discharge orifices 118. In FIG. 5, there are six discharge orifices per bladder, three in each piece of plastic, which are preferably at the same level in the bladder. These discharge orifices may be formed after the two pieces of plastic are joined together by punching holes through both pieces of plastic at the same time. The discharge orifices 118 provide a substantial advantage over the '699 patent because they allow the water to substantially fill the bladder 110, then to flow out of bladder 110 and cascade down its exterior surface. Needless to say, a plastic surface that is covered with running water on one side and is filled with water on the other side is substantially more fire resistant than a plastic surface that has water running only on the inside, and not towards the fire.

Apparatus 500 shown in FIG. 5 includes a bottom portion 510 that connects all of the bladders 110 together. This configuration assures that the bladders 110 are aligned one with another to provide an effective barrier to fire and smoke. In addition, the common bottom portion 510 can compensate for one or more discharge nozzles 120 that do not function correctly. Even if all discharge nozzles 120 in a particular bladder are clogged and won't work, the water from other bladders 110 will flow through the common bottom portion 510 and fill the bladder anyway. The common bottom portion 510 thus provides an effective way to assure the bladders 110 fill with water, even if some of the discharge nozzles clog.

In the most preferred implementation of apparatus 500, each bladder 110 is separated from its neighboring bladders. This allows a person to push through between two bladders, providing an escape route for persons in a burning building and providing easy access to the fire by firefighters. These separations would even allow firefighters to stand behind the apparatus and place the water nozzle of a fire hose through the separations to fight the fire while being protected from the fire by the apparatus 500. Of course, the preferred embodiments also expressly extend to each bladder being coupled to its neighboring bladders without separations, thereby creating a wall that does not provide easy passage. This configuration would be particularly well suited to a stationary apparatus that is placed between buildings or between rooms in a building to constantly provide fire protection between two areas.

Figure 6:
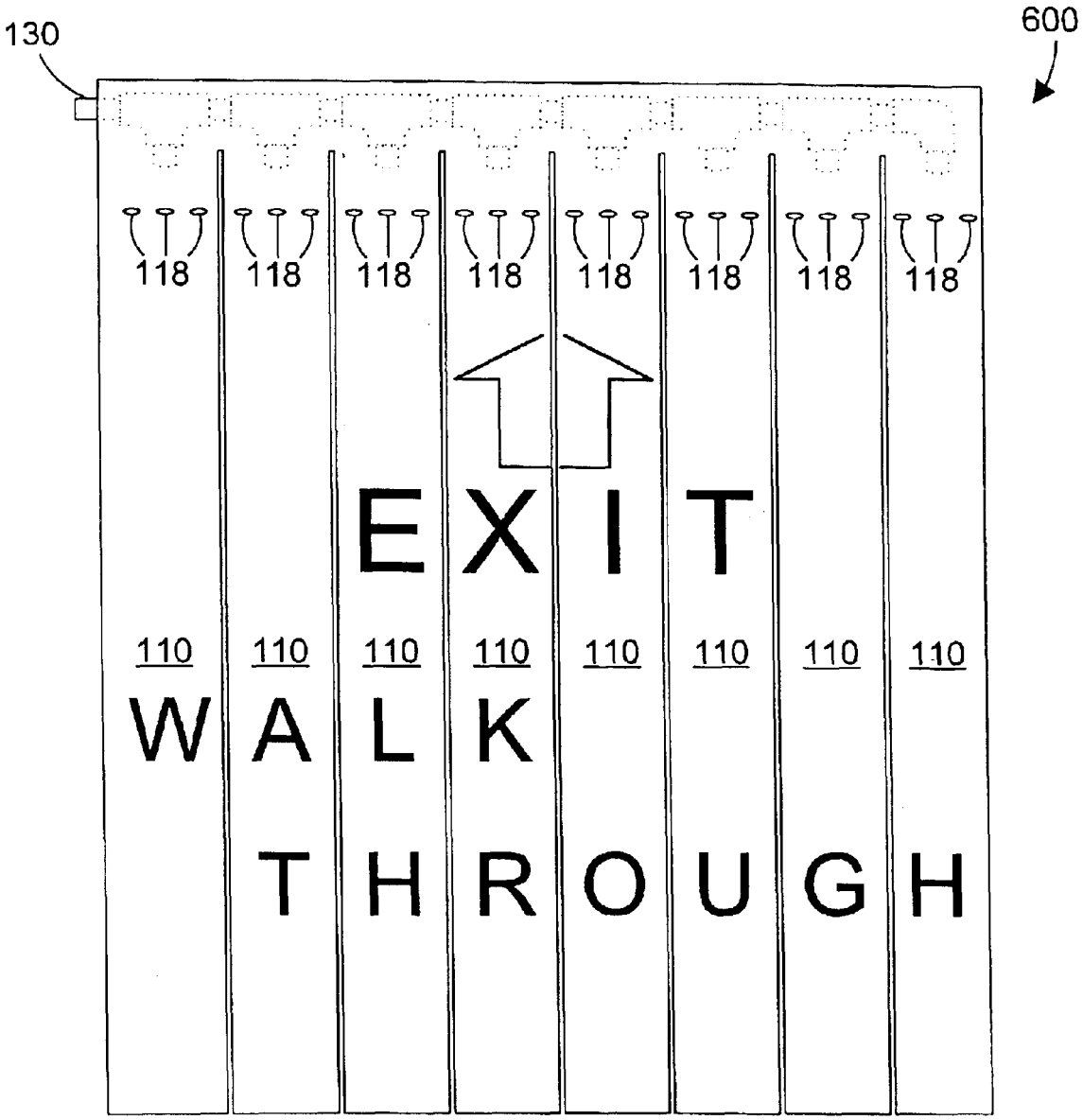
FIG. 6 is a front view of a second specific implementation of the fire protection apparatus of the preferred embodiments, where the bottom portions of each bladder are separate, allowing a person to easily walk through the hanging bladders.

A different implementation of a fire protection apparatus is shown as apparatus 600 in FIG. 6. Note that apparatus 600 shares some common features with apparatus 500 in FIG. 5, namely: the manifold 130 is the same, there are the same number of bladders 110, and each bladder 110 includes similar discharge orifices 118. There are two significant differences between apparatus 600 in FIG. 6 and apparatus 500 in FIG. 5. First, in apparatus 500, there is a common bottom portion 510 that joined all bladders 110 together. In apparatus 600, in contrast, there is no common bottom portion. The bottom portion of each bladder 110 is separate from the bottom portion of its neighbor bladders. As with apparatus 500 of FIG. 5, apparatus 600 may optionally include one or more separations between bladders that allow a person to easily pass through the apparatus 600. In the specific configuration shown in FIG. 6, each bladder 110 could be separated from each other bladder 110, resulting in a curtain of individual vertical bladders that may be easily parted for a person to pass through. A second significant difference between apparatus 500 in FIG. 5 and apparatus 600 in FIG. 6 is the presence of evacuation instructions that help people know where to go. The evacuation instructions in FIG. 6 include an "EXIT" designation with an arrow pointing to the direction of the exit, along with text "walk through" that instructs people that they can walk through the bladders of apparatus 600. A simple example will illustrate the need for evacuation instructions on the apparatus 600. Let's assume that the apparatus 600 of FIG. 6 is deployed in numerous locations in a large hospital. When a fire alarm sounds, multiple apparatus 600 may deploy to separate the hospital into small sections to avoid the spread of fire between sections. In this scenario, a person may have to pass through two or three (or more) apparatus 600 before reaching an exit. In this example of a large hospital, it would therefore be very useful to have evacuation instructions printed on the bladders so a person who is inside a building with an alarm sounding will know where to go to find an exit. The preferred embodiments expressly extend to any form of evacuation instructions, including text in any language and any suitable symbol that can help people to know where to go to evacuate the building.

Figure 7:
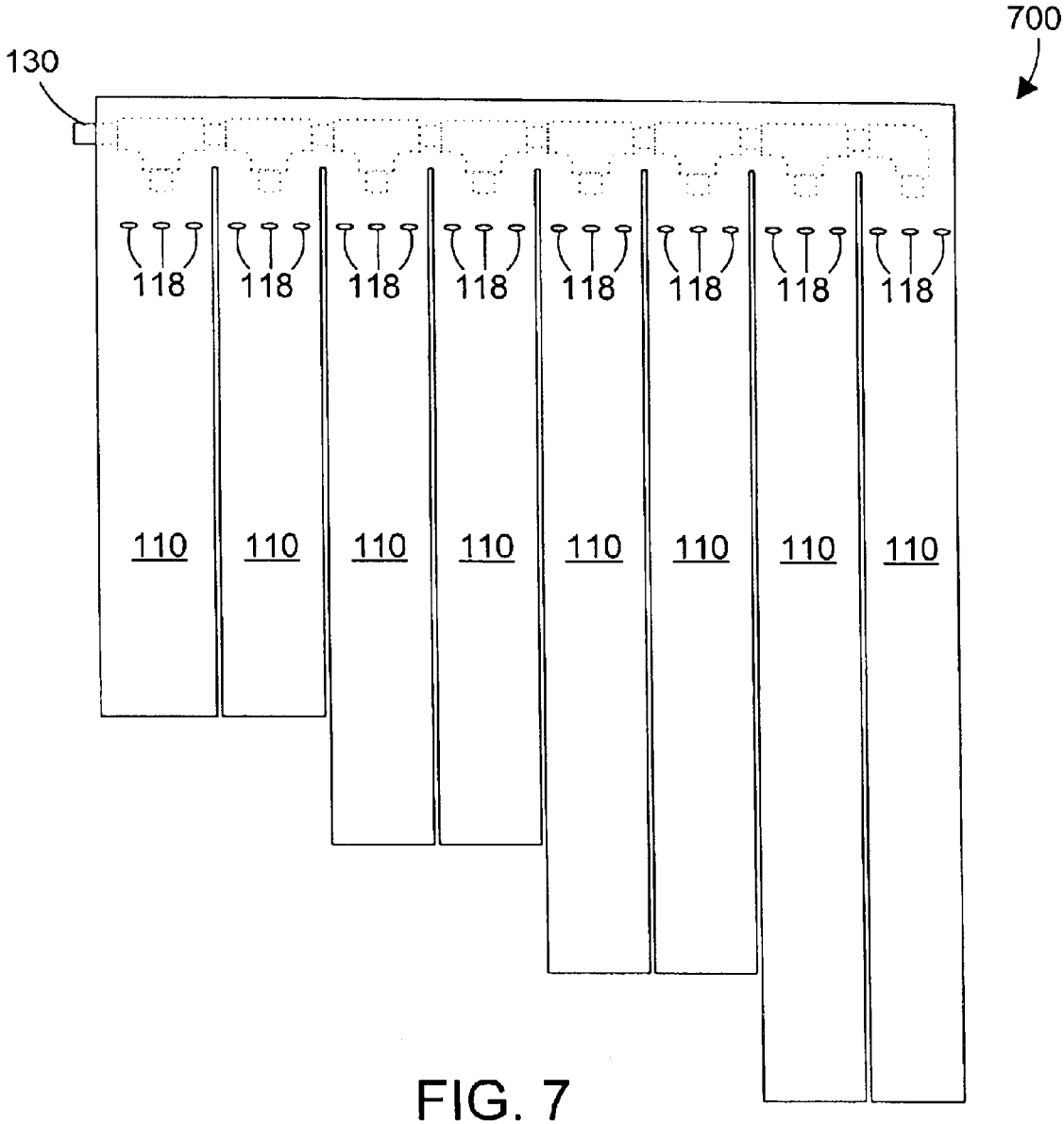
FIG. 7 is a front view of a third specific implementation of the fire protection apparatus of the preferred embodiments, where the bottom portions of the bladders have different lengths to accommodate use on a stairway.
Figure 8:
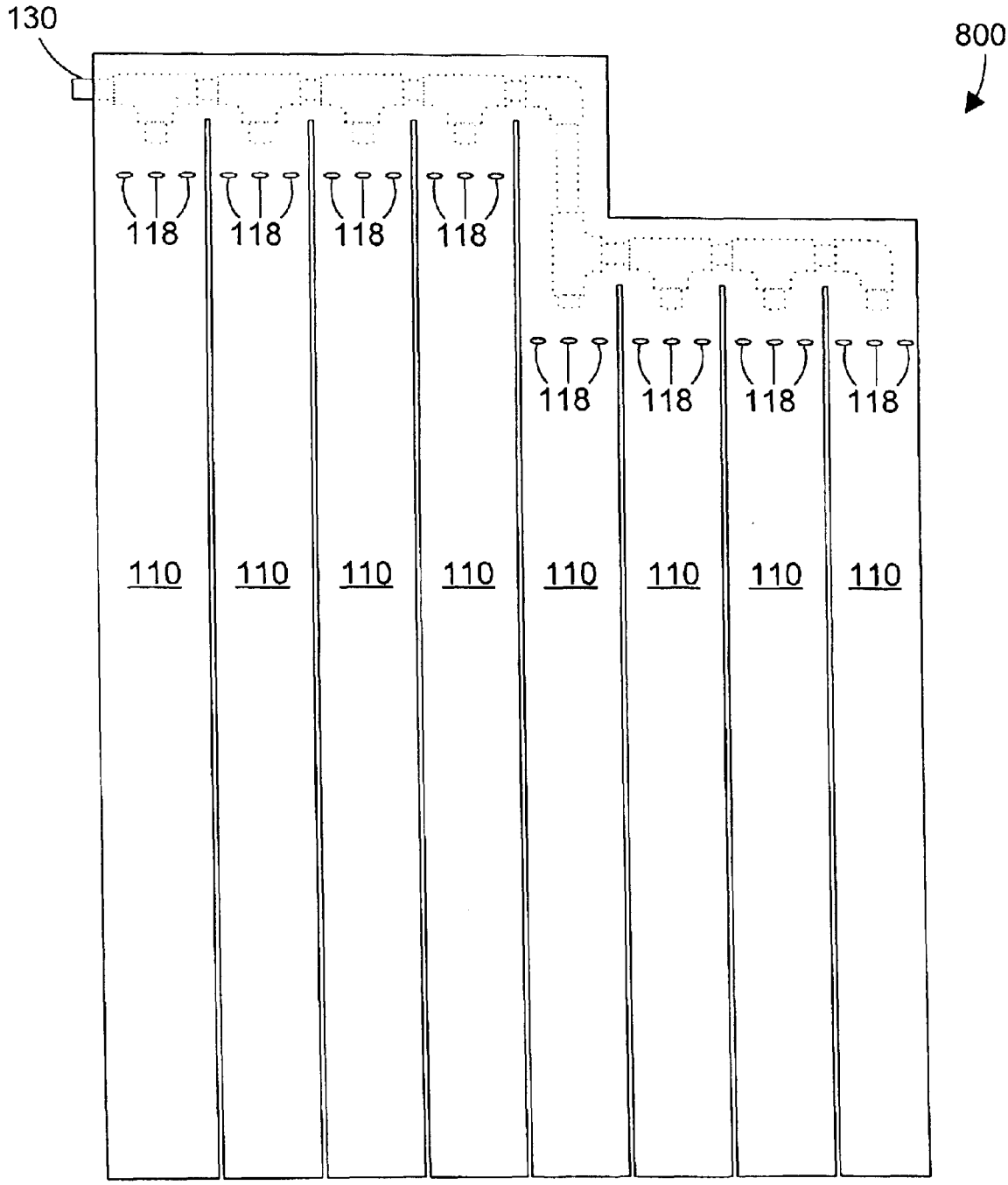
FIG. 8 is a front view of a fourth specific implementation of the fire protection apparatus of the preferred embodiments, where the top portion of the apparatus is stepped to accommodate a stepped ceiling.

One significant advantage of the apparatus of the preferred embodiments is that it is made of flexible plastic material that may be easily fabricated into any suitable shape for special applications. For example, an apparatus 700 in FIG. 7 includes bladders of different lengths that make apparatus 700 specially suited for use on a stairway. An apparatus 800 in FIG. 8 includes a stepped top portion and manifold that make the apparatus 800 specially suited for use in an area where the ceiling is stepped.

Note that the bladders may be made of any suitable flexible material. One example of a lightweight, inexpensive flexible material is plastic similar to the plastic used for inflatable pool toys. Of course, heavier more durable plastic, such as mylar or other plastic materials, may also be used. In addition, fire-resistant plastics may be used, or plastics with fire resistant coatings or laminates may also be used. For example, it has been found that inexpensive plastic bonded to a thin sheet of metal void provides fire resistant properties, because the heat of a flame on the foil is spread over a wider area of plastic due to the heat conduction properties of the metal foil. The preferred embodiments expressly extend to any suitable flexible material.

Note that the flexible material in one specific embodiment is a non-permeable material that is a complete barrier to water. Thus, in the configuration shown in FIGS. 5–8, we assume the flexible material holds water without leaking. This causes the bladders 110 to fill to the level of their discharge orifices 118. Once to this level, the water continues to flow out of nozzles into the bladders 110, and out the discharge orifices 118. At this point, the water cascades down the outside of the bladders 110, thereby coating the outside of the bladder with water. In an alternative configuration, the flexible material may be made of a semi-permeable flexible material that allows water to slowly seep through. With this configuration, the discharge orifices could be eliminated, if desired. The bladders 110 would begin to fill, and under the pressure of the water inside the bladders, some water would seep through the semi-permeable material to the outside of the bladders. This water would then cascade down the outside of the bladders under force of gravity.

Once the bladders become completely full, the pressure from the manifold could increase the rate of seepage through the semi-permeable material, causing the water to flow in greater quantities through the bladder walls and down the exterior of the bladders. In this fashion, a semi-permeable material may be used within the scope of the preferred embodiments to provide a substantially filled bladder on the inside with water cascading on the outside.

The flexible material of the preferred embodiments may be any color, and may be translucent or opaque. In the most preferred embodiments, the flexible material is preferably clear and transparent or translucent, thereby allowing a person to see some things through the water-filled bladders. While a person would not see any great detail looking through water-filled bladders, gross details may be visible. For example, if fire is raging just on the other side of the apparatus, the fire would likely be visible through the bladders. If a person has fallen on the floor and is unconscious on the other side of the apparatus, a firefighter may be able to see through the water-filled bladders to recognize there is a person that needs help. The ability to see through the water-filled bladders is a significant advantage of the present invention.

Figure 9:
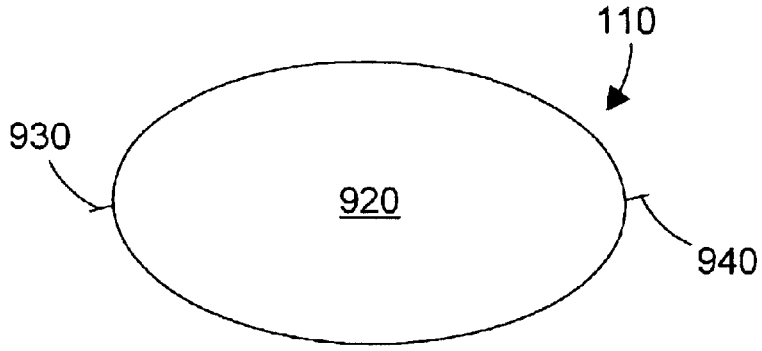
FIG. 9 if an enlarged cross-sectional view of a single bladder in accordance with one specific configuration within the scope of the preferred embodiments.
Figure 10:
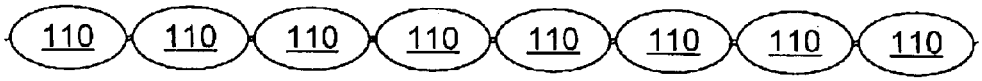
FIG. 10 is a top cross-sectional view of eight of the bladders in FIG. 9 that form a fire protection apparatus in accordance with the preferred embodiments.

The preferred embodiments expressly extend to any suitable arrangement of multiple bladders. Examples of suitable arrangements are shown in FIGS. 9–13. FIG. 9 is an enlarged cross-sectional view of a single bladder 110. Note that bladder 110 includes an interior portion 920, along with two plastic flanges 930 and 940 on the exterior portion. FIG. 10 shows several of the bladders 110 of FIG. 9 arranged side by side. Note that these bladders 110 may be attached together to form a barrier, or may include one or more separations between bladders that allow a person to pass through the bladders by parting the bladders and stepping through. In the most preferred configuration, each bladder 110 has a separation from each other bladder, allowing a person to push on any bladder and move it out of the way to provide room to step through. In this configuration, flanges 930 and 940 of each bladder 110 shown in FIG. 9 will overlap the flanges on the neighbor bladders, providing an effective barrier to the spread of fire and smoke, even though each bladder hangs separately from its neighbors.

Figure 11:
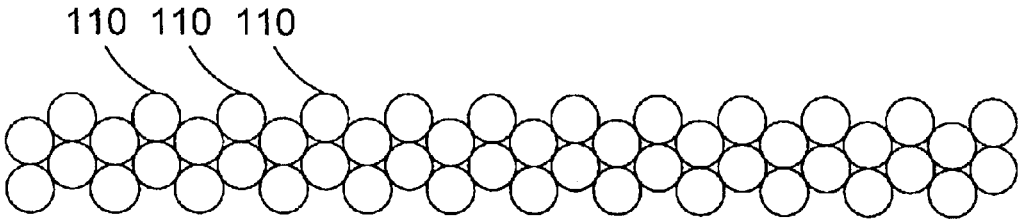
FIG. 11 is a top cross-sectional view of circular bladders that form a fire protection apparatus in accordance with the preferred embodiments.

An alternative configuration within the scope of the preferred embodiments is shown in FIG. 11 to include multiple small, round bladders that hang one against the other to form an effective barrier to the spread of fire and smoke. Each bladder may be separate from each other bladder, or they may be connected in groups as desired. In addition, all bladders may be attached to each other if people do not need to pass through the apparatus to evacuate.

Figure 12:
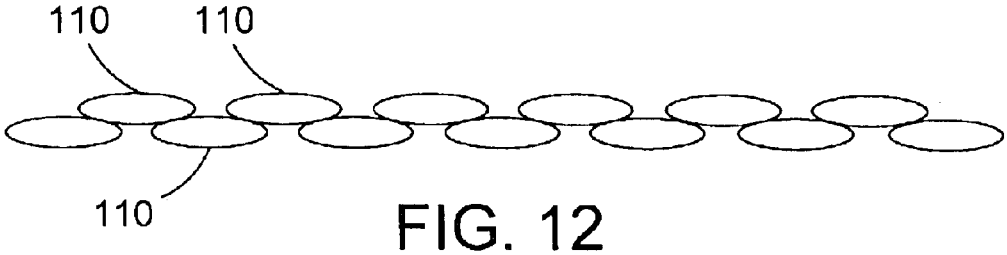
FIG. 12 is a top cross-sectional view of oval bladders that form a fire protection apparatus in accordance with the preferred embodiments.
Figure 13:
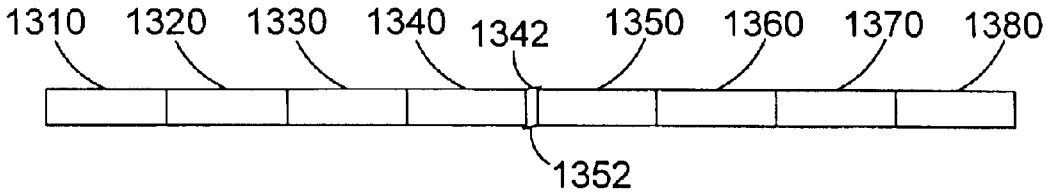
FIG. 13 is a top cross-sectional view of rectangular bladders that form a fire protection apparatus in accordance with the preferred embodiments.

Another alternative configuration is shown in FIG. 12 to be two rows of overlapping bladders. Yet another alternative configuration is shown in FIG. 13 to include four bladders 1310, 1320, 1330 and 1340 coupled together to form one half of the barrier and another four bladders 1350, 1360, 1370 and 1380 coupled together to form the second half of the barrier. While these two halves could be attached together to form a barrier, the most preferred implementation includes a separation in the middle that allows a person to part the two halves and walk through. Note that bladder 1340 preferably includes a flange 1342, and bladder 1350 preferably includes a flange 1352 that create a seal between the halves to provide an effective barrier to the spread of fire and smoke.

Note that a flexible bladder will have the tendency to form a circular shape once filled with water. The shape of a bladder may be made non-circular (such as oval-shaped in FIGS. 9, 10 and 12, or rectangular in FIG. 13) by placing internal webs within the bladder to keep the bladder in the desired shape. For example, to keep the bladder 920 of FIGS. 9 and 10 in an oval shape, an internal vertical web could be attached to the top portion and the bottom portion in FIG. 9. This web would preferably run the entire length of the bladder, but could also comprise multiple separate webs along the length of the bladder. In this manner bladders may be manufactured that have varying shapes that will substantially retain their shapes once filled with a non-flammable liquid.

Another way to help maintain a desired shape in a bladder is to provide a coiled structure, similar to a Slinky toy, within the bladder. Slinky is a registered trademark of James Industries, Inc. in Hollidaysburg, Pa. The coiled structure could be attached at the top and bottom of a bladder, and would extend as the bladder deploys due to it filling with water. The Slinky toy is typically round. Note, however, that the coiled structure that may be used in a bladder may have any suitable shape. The most preferred implementation of the coiled structure is plastic because it will not corrode in water and is lightweight. Thus, an oval-shaped coiled structure could be included in a bladder to help the bladder maintain an oval shape when filled with water.

The applications for the apparatus of the preferred embodiments are numerous. One specific application is in a building, where multiple units are installed within a ceiling area and deploy to create a barrier to the spread of fire and smoke when a fire alarm goes off. The apparatus could be used in doorways, hallways, elevators, stair wells, or as fire doors (or at fire doors to provide additional protection). The apparatus of the preferred embodiments could additional include one or more nozzles external to bladders 110 that spray on a neighboring fire door or that spray the upper portion of the apparatus to provide better fire protection.

Another use of the apparatus of the preferred embodiments is as a fire suppression system for a grill in a restaurant. Known fire suppression systems for restaurant grills discharge significant quantities of chemicals that require significant clean up, and may require approval of inspectors to assure the area is sufficiently clean before the grill may be cleared for further use in preparing food. The apparatus of the preferred embodiments could be deployed in a rectangle surrounding the grill area, which would inhibit the spread of fire and smoke in a simple and effective manner without contaminating the food or grill. The only drawback is the water that cascades down the bladders onto the floor (or other surface upon which the bottom of the bladders rest). However, water in a kitchen area is typically not a big problem because most commercial kitchens include floor drains that simplify cleaning the floors. Thus, the excess water flowing off the bladders could flow on the floor and down a nearby floor drain without causing excessive flooding in the kitchen.

Another specific implementation for the apparatus of the preferred embodiments is on an aircraft, cruise ship, or other vehicle. Fire may spread rapidly in an aircraft, cruise ship, or other vehicle. The apparatus of the preferred embodiments could be installed in the ceiling of an aircraft, cruise ship, or other vehicle, and could be deployed in an emergency that includes fire, smoke, chemical leaks, etc. The apparatus could effectively partition off the vehicle into multiple sections, thereby localizing a problem to only one section of the vehicle. In an aircraft scenario, it may be unpractical to carry the amount of water that would be required to fill the bladders. In an alternative, a lightweight fire retardant foam could be used to fill the bladders instead of water. As stated above, any non-flammable liquid could be used, including those such as foam that are viscous and do not flow particularly well. In the cruise ship scenario, sea water could be pumped into the bladders when needed.

Another specific implementation for the apparatus of the preferred embodiments is to create a room that is surrounded with water-filled bladders that can serve as a specific room that is more fire resistant than other rooms. In one implementation, a certain room one each floor of a high rise office building could be designated as a place of gathering during a fire. The apparatus of the preferred embodiments could then be used to surround the room with water-filled bladders. This could buy several minutes of time during a fire for firefighters to rescue people that may be trapped. Note that a configuration similar to apparatus 500 could be used to lay flat under a floor or above a ceiling within the scope of the preferred embodiments, provided the discharge orifices 118 are not present in the bladders. Rooms protected in this manner could use the deployable version of the apparatus, or could use the stationary bladders filled with water upon installation.

Yet another specific application for the apparatus of the preferred embodiments is on a fire department's ladder truck. Ladder trucks often include buckets that may be extended to a window of a burning building. The bucket on a ladder truck typically includes a hose nozzle, thereby providing a nearby source of water. An apparatus in accordance with the preferred embodiments could be deployed on the bucket facing the building. Once filled with water, the bladders could be placed against a window or window opening. The firefighter could then potentially see through the water-filled bladders to determine if there are flames in the room, or to potentially see if there are victims that need to be rescued. In the case of a rescue, a firefighter could actually grab a person at a window and pull them through the water-filled bladders to safety while only subjecting his arms and hands to the heat of the fire.

A second preferred embodiment of the invention uses the apparatus to create stationary installations of barriers. For example, let's assume you buy an old building in downtown Philadelphia, and wish to open an art gallery. Let's also assume that one of your neighbors is a restaurant, with a kitchen that shares the wall with your building. You begin to worry that a fire in the neighbor's kitchen could spread to your building, potentially destroying some very valuable pieces of art. In response to this worry, you could install a stationary apparatus that includes multiple bladders with a manifold 130 that directs water into the bladders between your building and the neighbor's. If there are two separate walls and sufficient space, the stationary apparatus could be deployed between the walls. In the alternative, if the wall is shared, a new wall could be created against the shared wall that would include the stationary apparatus. Once installed, water could be connected to the apparatus, and the bladders would then be substantially filled. By providing a stationary version of the apparatus, an inexpensive fire barrier may be created that need not be deployed only when an alarm sounds, but can be always filled with water because it is stationary and preferably hidden within a wall. Note that the stationary apparatus could include one or more separations between bladders, especially if the stationary apparatus spans an exit door or window through which a person may need to pass to evacuate the premises.

The preferred embodiments provide a significant advance over the art. Water-filled bladders create a barrier to the spread of smoke and fire. In one specific embodiment, the apparatus is in a collapsed position in an overhead location. When a fire alarm sounds, water is directed into the collapsed bladders. The weight of the water filling the bladders causes the apparatus to deploy downward until it contacts the floor or other mating surface. If the bladders are made of a non-permeable material, each bladder suitably includes one or more discharge orifices that define the level of water to be held by the bladders. Once the water reaches the level of the discharge orifices, it flows out of the bladder and cascades down the outside of the bladder, thereby coating the outside of the bladder with water. If the bladders are made of a semi-permeable material, water may seep out of the bladder and run down the exterior of the bladder without the use of discharge orifices. In a second specific embodiment, the apparatus if installed in a stationary position, and its bladders are then substantially filled with water to provide a static fire barrier.

One skilled in the art will appreciate that many variations are possible within the scope of the present invention. Thus, while the invention has been particularly shown and described with reference to preferred embodiments thereof, it will be understood by those skilled in the art that these and other changes in form and details may be made therein without departing from the spirit and scope of the invention. For example, lightweight materials could be included in the bladders to take up space in the bladders, thereby decreasing the weight of the bladders when filled. For example, styrofoam granules or pellets could be added to the bladders in the deployable apparatus, or styrofoam tubes or cylinders could be added to the bladders in the stationary apparatus. Another way to decrease the weight of the bladders is to create a double-walled bladder, where the non-flammable liquid occupies the space between the two bladder walls while the interior of the bladder is left hollow. These and other modifications are within the scope of the preferred embodiments.

I claim:

1. A fire protection apparatus comprising:

a plurality of bladders formed of flexible material, each bladder including at least one orifice on a sidewall of the bladder and positioned near a top portion of the bladder; and a manifold that provides at least one discharge nozzle in an upper portion of each of the plurality of bladders, wherein non-flammable liquid passes through the manifold and out of the at least one discharge nozzle to fill each of the plurality of bladders with the non-flammable liquid up to the level of the at least one orifice.

2. A fire protection apparatus comprising:

a plurality of bladders formed of flexible material, each bladder including at least one orifice positioned near a top portion of the bladder; and a manifold that provides at least one discharge nozzle in an upper portion of each of the plurality of bladders, wherein non-flammable liquid passes through the manifold and out of the at least one discharge nozzle to fill each of the plurality of bladders with the non-flammable liquid up to the level of the at least one orifice;

wherein the non-flammable liquid, once to the level of the at least one orifice in a bladder, overflows from the interior of the bladder to the exterior of the bladder and flows down the exterior of the bladder.

3. The apparatus of claim 1 further comprising a separation between at least two of the plurality of bladders that allows a person to pass through the apparatus when the plurality of bladders are filled to the level of the at least one orifice with the non-flammable liquid.

4. The apparatus of claim 1 further comprising a bottom portion that joins together the plurality of bladders.

5. The apparatus of claim 1 wherein the plurality of bladders is initially in a collapsed state, and changes to a deployed state when the non-flammable liquid passes through the manifold and begins to fill the plurality of bladders.

6. The apparatus of claim 5 wherein the apparatus in the collapsed state is in proximity to a ceiling, and wherein the apparatus in the deployed state extends from the ceiling to a floor below.

7. The apparatus of claim 1 further comprising evacuation instructions on the exterior of the plurality of bladders.

8. The apparatus of claim 1 wherein the flexible material comprises non-permeable material.

9. A fire protection apparatus comprising:

a plurality of bladders formed of flexible material, each bladder including at least one orifice positioned near a top portion of the bladder; and a manifold that provides at least one discharge nozzle in an upper portion of each of the plurality of bladders, wherein non-flammable liquid passes through the manifold and out of the at least one discharge nozzle to fill each of the plurality of bladders with the non-flammable liquid up to the level of the at least one orifice;

wherein the flexible material comprises a semi-permeable material that allows the non-flammable liquid to seep through the semi-permeable flexible material and thereby coat an exterior of each bladder with the non-flammable liquid.

10. A fire protection apparatus comprising:

a plurality of bladders formed of flexible material and substantially filled with a non-flammable liquid;

a top portion that joins together the plurality of bladders; and wherein each of the plurality of bladders includes at least one orifice positioned near a top portion of the bladder, and wherein the plurality of bladders are filled with the non-flammable liquid to a level at or below the level of the at least one orifice.

11. A fire protection apparatus comprising:

a plurality of bladders formed of flexible material and substantially filled with a non-flammable liquid, each bladder including at least one orifice positioned near a top portion of the bladder;

a top portion that joins together the plurality of bladders; and a manifold that provides at least one discharge nozzle in an upper portion of each of the plurality of bladders, wherein non-flammable liquid passes through the manifold and out of the at least one discharge nozzle to fill each of the plurality of bladders with the non-flammable liquid up to the level of the at least one orifice.

12. The apparatus of claim 10 further comprising a bottom portion that joins together the plurality of bladders.

13. The apparatus of claim 10 further comprising a separation between at least two of the plurality of bladders that allows a person to pass through the apparatus when the plurality of bladders are filled to the level of the at least one orifice with the non-flammable liquid.

14. The apparatus of claim 10 further comprising evacuation instructions on the exterior of the plurality of bladders.

15. The apparatus of claim 10 wherein the flexible material comprises non-permeable material.

16. A fire protection apparatus comprising:

a plurality of bladders formed of flexible material and substantially filled with a non-flammable liquid; and a top portion that joins together the plurality of bladders;

wherein the flexible material comprises semi-permeable material.

17. A fire protection apparatus comprising:

a plurality of bladders formed of semi-permeable flexible material; and a manifold that provides at least one discharge nozzle in an upper portion of each of the plurality of bladders, wherein non-flammable liquid passes through the manifold and out of the at least one discharge nozzle to fill each of the plurality of bladders with the non-flammable liquid, wherein the liquid seeps through the semi-permeable flexible material and thereby coats an exterior of each bladder with the non-flammable liquid.

18. A fire protection apparatus comprising:

a plurality of bladders formed of flexible material, each bladder including at least one orifice positioned near a top portion of the bladder, the plurality of bladders initially being at least partially collapsed;

a manifold that provides at least one discharge nozzle in an upper portion of each of the plurality of bladders, wherein non-flammable liquid passes through the manifold and out of the at least one discharge nozzle into the plurality of bladders;

a top portion of the apparatus that encloses the at least one discharge nozzle on the manifold, the top portion being fixedly coupled to a structural member capable of supporting the plurality of bladders when the plurality of bladders are substantially filled with a non-flammable liquid;

side portions of each of the plurality of bladders that initially are at least partially collapsed so the plurality of bladders fit within a compartment in a ceiling; and at least one spring-loaded door that has a spring strength sufficient to hold the at least partially collapsed bladders within the compartment in the ceiling, and that opens when the bias of the spring is overcome by the weight of the non-flammable liquid filling the plurality of bladders.

19. A method for protecting an area from the spread of fire and smoke, the method comprising the steps of:

(A) installing a fire protection apparatus, the fire protection apparatus comprising:

a plurality of bladders formed of flexible material, each bladder including at least one orifice positioned near a top portion of the bladder, the plurality of bladders initially being at least partially collapsed; and a manifold that provides at least one discharge nozzle in an upper portion of each of the plurality of bladders, wherein the manifold is coupled to a source of non-flammable liquid;

(B) directing non-flammable liquid through the manifold into the plurality of at least partially collapsed bladders, wherein the weight of the non-flammable liquid filling the plurality of bladders causes the plurality of bladders to extend to a substantially non-collapsed state, wherein after extension of the plurality of bladders each of the plurality of bladders continues to fill with the non-flammable liquid up to the level of the at least one orifice; and (C) continuing to direct the non-flammable liquid through the manifold into the plurality of bladders to cause the non-flammable liquid to overflow out of the at least one orifice in each bladder and flow down an exterior portion of the bladder.

20. The method of claim 19 wherein the flexible material comprises non-permeable material.

21. The method of claim 19 wherein the flexible material comprises a semi-permeable material that allows the non-flammable liquid to seep through the semi-permeable flexible material and thereby coat an exterior of each bladder with the non-flammable liquid.

22. The method of claim 19 further comprising the step of spraying the non-flammable liquid on an upper exterior portion of the plurality of bladders.

23. A method for protecting an area from the spread of fire and smoke, the method comprising the steps of:

(A) installing a fire protection apparatus comprising:
a plurality of bladders formed of flexible material; and
a manifold that provides at least one discharge nozzle in an upper portion of each of the plurality of bladders;

(B) substantially filling the plurality of bladders in the fire protection apparatus by directing a non-flammable liquid through the manifold and at least one discharge nozzle into the plurality of bladders;

wherein each bladder includes at least one orifice positioned near a top portion of the bladder, and step (B) comprises the step of filling each bladder with the non-flammable liquid to the level of the at least one orifice.

24. The method of claim 23 wherein at least some of the plurality of bladders at least partially overlap.

25. The method of claim 23 wherein the flexible material comprises non-permeable material.

26. A method for protecting an area from the spread of fire and smoke, the method comprising the steps of:

(A) installing a fire protection apparatus comprising:
a plurality of bladders formed of flexible material; and
a manifold that provides at least one discharge nozzle in an upper portion of each of the plurality of bladders;

(B) substantially filling the plurality of bladders in the fire protection apparatus by directing a non-flammable liquid through the manifold and at least one discharge nozzle into the plurality of bladders;

wherein the flexible material comprises a semi-permeable material that allows the non-flammable liquid to seep through the semi-permeable flexible material and thereby coat an exterior of each bladder with the non-flammable liquid.

27. A method for protecting an area from the spread of fire and smoke, the method comprising the steps of:

(A) installing a fire protection apparatus comprising:
a plurality of bladders formed of flexible material; and
a manifold that provides at least one discharge nozzle in an upper portion of each of the plurality of bladders;

(B) substantially filling the plurality of bladders in the fire protection apparatus by directing a non-flammable liquid through the manifold and at least one discharge nozzle into the plurality of bladders; and (C) spraying the non-flammable liquid on an upper exterior portion of the plurality of bladders.

* * * * *